US005447625A

United States Patent [19]

Roe

[11] Patent Number: 5,447,625

[45] Date of Patent: Sep. 5, 1995

[54] ELECTROMAGNETIC SHIELDING FOR A LIQUID CONDITIONING DEVICE

[76] Inventor: Samuel R. Roe, 2857 N. Oakwood Ave., Muncie, Indiana 47304

[21] Appl. No.: 106,305

[22] Filed: Aug. 12, 1993

Related U.S. Application Data

[63] Continuation of Ser. No. 883,951, May 15, 1992, abandoned.

[51] Int. Cl.[6] ..... F02M 27/04

[52] U.S. Cl. ..... 210/243; 123/538

[58] Field of Search ..... 210/243; 123/536–539; 174/6, 35 R, 35 MS, 35 GC

[56] References Cited

U.S. PATENT DOCUMENTS 4,392,083 7/1983 Costello ..... 174/35 CE
4,930,483 6/1990 Jones ..... 123/538
4,959,155 9/1990 Gomez ..... 210/687
5,044,347 9/1991 Ullrich et al. ..... 123/538
5,069,190 12/1991 Richards ..... 123/538

*Primary Examiner*—Matthew O. Savage
*Attorney, Agent, or Firm*—Cherskov and Flaynik

[57] ABSTRACT

A dissimilar alloy type conditioner for conditioning liquid fuel in a motor vehicle is provided with shielding to protect the conditioner from electromagnetic interference which would render the conditioner ineffective. A conditioner is preferably covered with shrink tubing, wrapped with aluminum foil, a ground wire entrapped between any two layers of foil, and provided with a suitable cover. The ground wire is connected to a convenient grounded screw. Rubber tubing connects the conditioner on both inlet and outlet sides to a metal fuel line. The invention is practiced in combination with the conditioner or as a kit, as for retrofitted installation.

8 Claims, 4 Drawing Sheets

ELECTROMAGNETIC SHIELDING FOR A LIQUID CONDITIONING DEVICE

This is a continuation of application Ser. No. 07/883,951 filed on May 15, 1992, now abandoned.

BACKGROUND OF THE INVENTION

1. Field of the Invention

The present invention relates to an improvement to a dissimilar alloy conditioner for conditioning a liquid and, more particularly, to shielding a dissimilar alloy conditioner against electromagnetic interference.

2. Description of the Prior Art

Imposition of electromagnetic effects upon liquids flowing in conduits has been found to produce desirable consequences. In some applications, substances dissolved in the liquid are caused to remain in suspension. This can be utilized to mitigate internal fouling of pipes by liquid-borne substances. In other applications, especially liquid hydrocarbon fuels atomized for use in internal combustion engines, the liquid dispersion upon being mixed with air is enhanced. This has the desirable effect of improving combustion efficiency, thus reducing pollution emitted by, particularly, motor vehicles.

Accordingly, conditioners for conditioning liquids have been developed for installation in a fuel line. At first, active devices producing magnetic fields by the incorporation of permanent magnets or by imposition of hard wired electrical or electromagnetic fields were brought forth. However, passive apparatus requiring neither permanent magnets nor electrical input have since been discovered. These passive conditioners typically comprise tubular bodies made from an alloy of dissimilar metals, the tubular body being inserted in the fuel line. An example of such a conditioner is U.S. Pat. No. 4,959,155, issued to Luis Gomez on Sep. 25, 1990.

Such a conditioner is thought to impart an electrostatic charge to the liquid, resulting in mutual repulsion of droplets and particles of the fluid during atomization. However, the principle of operation is not clearly understood.

Effectiveness of these conditioners has been found to be reduced and at times absent. Because the principle of operation is not clearly understood, attempts to solve the problem of sporadically reduced effectiveness have not resulted in conclusive success.

In U.S. Pat. No. 5,069,190, issued on Dec. 3, 1991 to Charlie W. Richards, it is proposed to locate the conditioner far from any "electrical source". Richards preferably wraps the conditioner with foil and paper, thus providing an electrical shield around the conditioner. Richards further indicates that the fuel line, which directly contacts his conditioner, may be made of metal. Those portions of the conditioner thus contacted are specified to be copper caps. These copper caps may incidentally contact the foil, as seen in FIG. 2 of '190. The foil and paper wrapping is also asserted to provide insulation.

U.S. Pat. No. 5,044,347, issued to Rolf Ullrich et al. on Sep. 3, 1991, teaches avoidance of grounding the conditioner. There is no teaching of shielding.

U.S. Pat. No. 4,930,483, issued to Wallace R. Jones on Jun. 5, 1990, teaches the importance of breaking electrical continuity between treated and untreated fuel. This is accomplished by non-conductive sections of fuel conduit placed in the fuel line, preferably upstream of the conditioner.

None of the above inventions and patents, taken either singly or in combination, is seen to describe the instant invention as claimed.

SUMMARY OF THE INVENTION

The present invention provides to a dissimilar metal alloy in-line conditioner for conditioning liquids, in combination: electrical shielding; shield grounding; electrical isolation of the conditioner from connection with ground; and electrical isolation of segments of fuel conduit contacting treated and untreated fuel from one another.

A conditioner (understood hereinafter to refer only to dissimilar metal alloy conditioners) is covered with insulation, the covered conditioner is then wrapped with an electrically conductive shield, an electrical conductor is placed in permanent contact with the shield and fastened to a convenient vehicle ground connection, and then covered with a mechanical shield. The conditioner is isolated from direct contact with metallic fuel line by replacement with a short segment of non-conductive fuel line on both the inlet and outlet sides of the conditioner.

A preferred first insulating layer is provided by shrink tubing. A preferred electrically conductive shield is provided by aluminum foil.

Accordingly, it is a principal object of the invention to improve effectiveness of a dissimilar metal alloy conditioner by adding, in combination, a grounded, electrically conductive shield isolated from electrical contact with the conditioner and electrical isolation between those segments of a fuel line contacting treated and untreated fuel, respectively.

It is another object of the invention to provide inexpensive and uncomplicated electromagnetic shielding of a conditioner.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
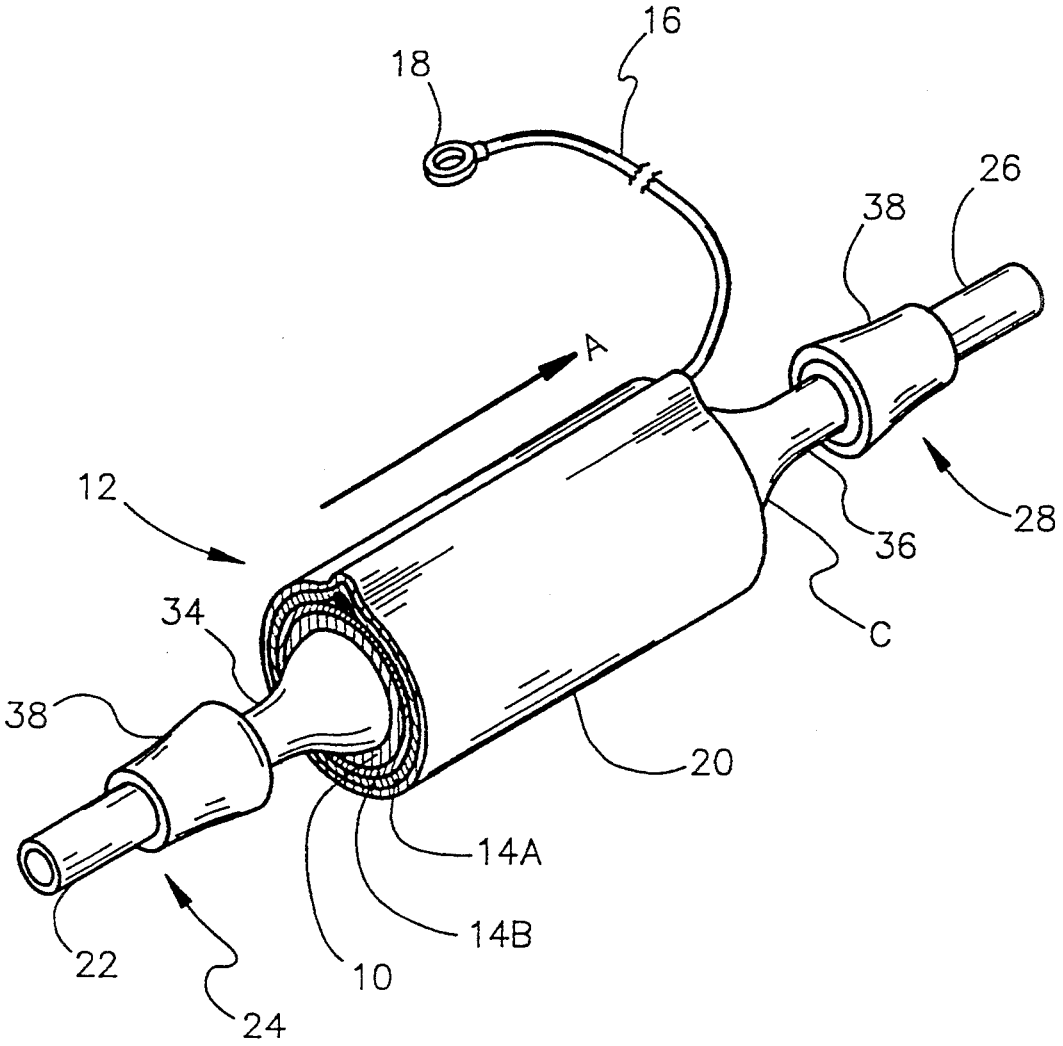
FIG. 1 is a perspective environmental view of the present invention.
Figure 3:
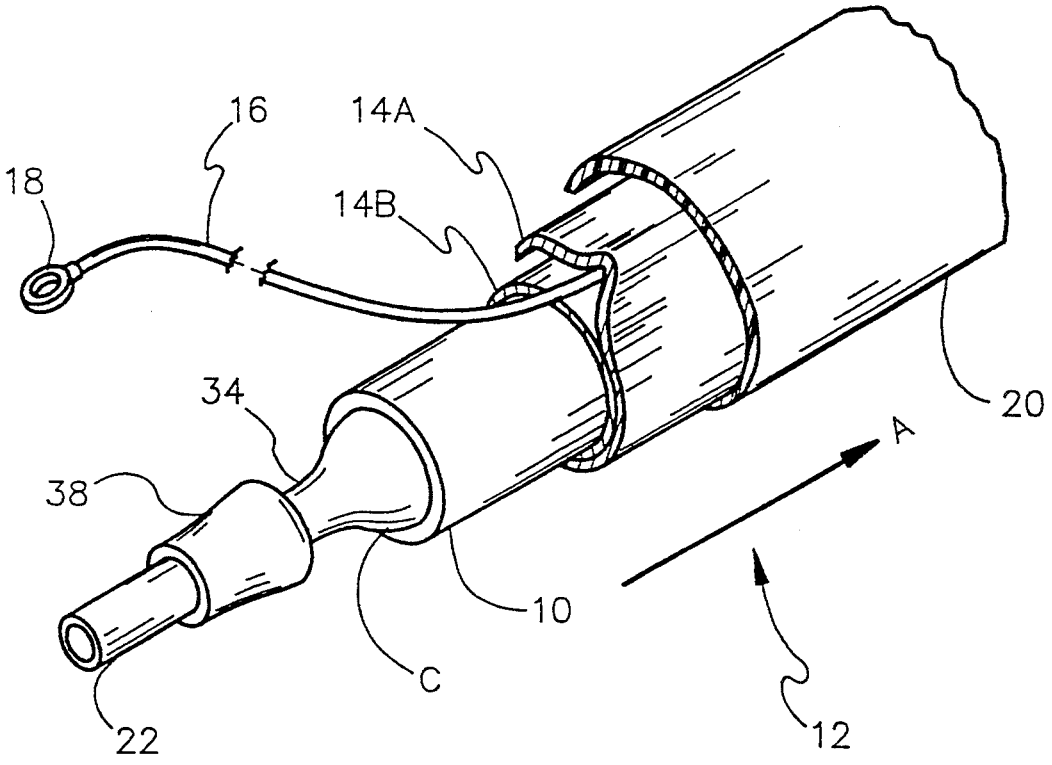
FIG. 3 is a detail view of the invention shown in FIGS. 1 and 2.

The present invention improves on prior art conditioners for conditioning liquids by the incorporation thereto of the following elements. As seen in FIG. 1, the conditioner C is first covered by an insulating sleeve 10. Insulating heat-shrunk tubing is a preferred material for this sleeve. An electrically conductive shield 12 is then provided upon metallic layers 14A, 14B being wound around the insulated conditioner C, aluminum foil having been found quite effective. A bare ground conductor 16 is laid between any two conductive layers 14A, 14B, the conductor 16 protruding from between the layers 14A, 14B and extending to a convenient ground connection (not shown). FIG. 3 clearly shows the relation existing among the conditioner C, the insulating sleeve 10, the foil shield 12 and the ground conductor 16.

In a preferred application of the invention, that is, to condition fuel for an engine of a motor vehicle, numerous screws and bolts electrically bonded to the vehicle ground system (not shown) are available. Any one screw or bolt (not shown) electrically connected to ground is removed and replaced, an eye 18 disposed on the ground conductor 16 being seated under the screw or bolt head prior to replacement thereof.

The conditioner C will be seen to this point to be shielded, the shield 12 being connected to ground (not shown), and the conditioner C being insulated against inadvertent ground connection. A protection cover 20 is preferably installed over the shield 10, as foils are delicate and susceptible to damage by incidental contact with solid objects.

Figure 2:
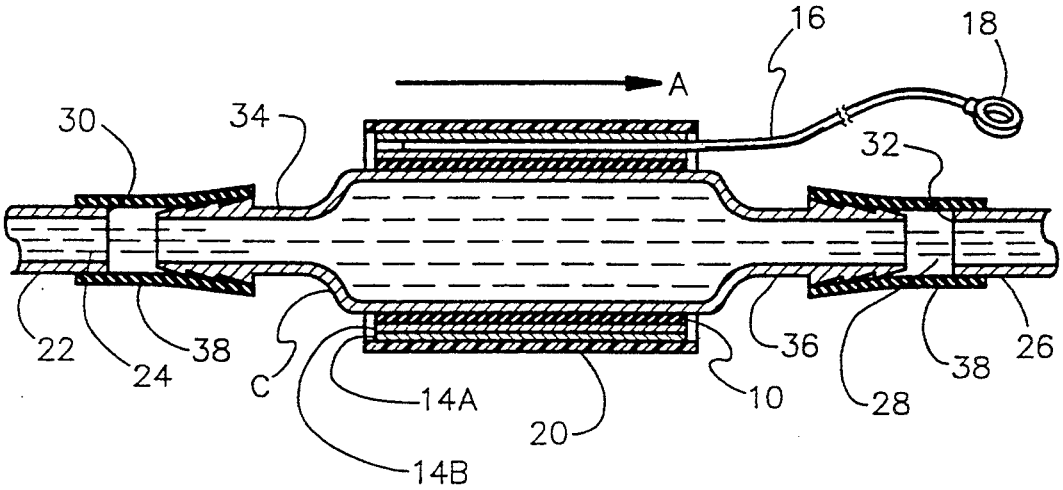
FIG. 2 is a cross sectional environmental view of the present invention.

Electrically conductive conduits, such as metal fuel lines, must have electrical contact broken between a fuel conduit segment 22 contacting untreated fuel 24, and a fuel conduit segment 26 contacting treated fuel 28. Turning now to FIG. 2, a fuel line, typically metallic, is shown severed into two segments 22, 26 for in-line installation of the conditioner C. The conditioner C does not entirely span a gap existing between two ends 30, 32 of the fuel conduit segments 22, 26. Connection between each segment end 30 or 32 and an associated inlet or outlet member 34 or 36 of the conditioner C is provided by a section 38 of non-conductive tubing positioned in the fuel line by being slipped over both the segment end 30 or 32 and the inlet or outlet member 34 or 36.

Electrical continuity between fuel conduit segments 22, 26 contacting untreated and treated fuel 24, 26 is thus broken. Treated fuel 26 is that portion of fuel which has already passed through the conditioner C, the effect of the conditioner C now impressed upon this fuel 26. Direction of fuel flow is indicated in the drawing figures by arrow A.

Figure 4:
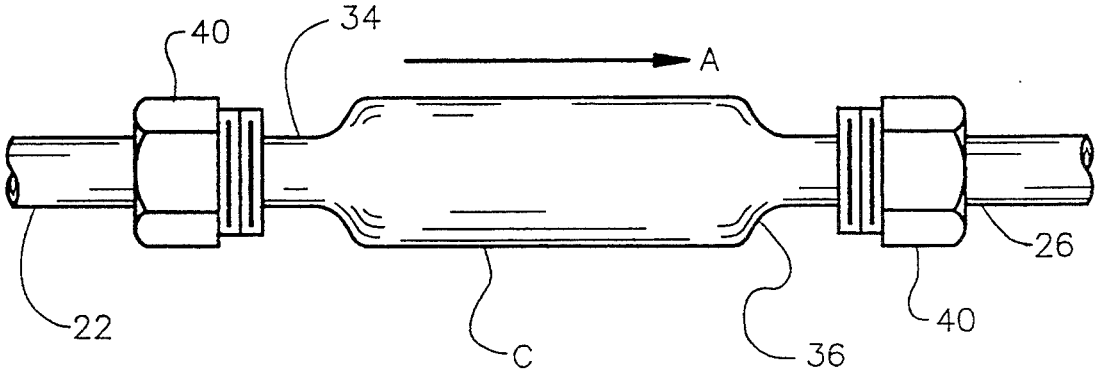
FIG. 4 PRIOR ART
FIG. 4 is a side elevational view of the prior art.

As can be readily appreciated from an inspection of FIGS. 1 and 4, the conditioner C includes a main body portion with outlet 34 at one end and outlet member 36 at the other end of the main body portion.

Prior art conditioners C, one-being represented in FIG. 4, are typically not shielded, and may have inadvertent ground paths, as illustrated by the connection of all metallic parts, as exemplified by metallic compression fittings 40 shown in FIG. 4.

When all elements of the present invention as set forth above are present, conditioners are found to have full effectiveness, as shown by test data presented hereinafter.

Tests corresponding to official EPA standards and testing methods for new vehicles and for individual devices affecting pollutants emitted by vehicles, known as the 511 program, have been run on four vehicles fitted with a conditioner improved according to the present invention. These tests were performed between Jan. 13, 1992 and Mar. 15, 1992 for Vitech Manufacturing, Inc., of Hialeah, Fla., the manufacturer of the conditioner used in the tests.

The testing agency was Automotive Testing Laboratories, Inc., of East Liberty, Ohio, an agency whose main business includes testing vehicles for compliance with EPA standards for many automobile manufacturers in the U.S.

A first test, designated 74F in the data tables, simulates intown driving, the vehicle being started after the engine is fully warm. A second test, designated 75F, is similar, but the engine is started while cold. These descriptions summarize, but do not totally define, the test procedure and all related steps.

The following test conclusions were reached, percentages referring to a reduction in tailpipe emissions as measured in parts per million, the reduction being attributable to the present invention.

| TEST | HYDROCARBONS | CARBON MONOXIDE |
|---|---|---|
| 74F | 20.4% | 39.8% |
| 75F | 16.6% | 26.4% |

The results shown encompass the fleet average. A minimum of 10.0% improvement in each pollutant category for each test was required to obtain EPA acceptance of the tested device as effective.

The invention may be provided in combination with a conditioner, or as a kit less the conditioner, as would be appropriate for retrofitting to a preexisting conditioner installed on a vehicle.

It is to be understood that the present invention is not limited to the sole embodiment described above, but encompasses any and all embodiments within the scope of the following claims.

I claim:

1. An in-line conditioner assembly for conditioning liquid fuel, said conditioner assembly comprising:

a dissimilar alloy conditioner having a main body portion including separate liquid inlet and liquid outlet members;

electrically conductive shield means covering said main body portion;

insulation means disposed between said electrically conductive shield means and said main body portion for electrically isolating said shield means from said main body portion and said liquid inlet member and said liquid outlet member;

ground means connected to said shield means for maintaining said shield means electrically bonded to a ground; and first non-conductive coupling means for coupling said liquid inlet member to a first electrically conductive fuel line, second non-conductive coupling means for coupling said liquid outlet member to a second electrically conductive fuel line, wherein said first and second non-conductive coupling means are configured and arranged to electrically isolate said conditioner from said first and second electrically conductive fuel lines, respectively.

2. The conditioner according to claim 1, wherein said shield means includes an outermost cover.

3. The conditioner according to claim 1, wherein said shield means is made from metal.

4. The conditioner according to claim 3, wherein said metal is aluminum.

5. The conditioner according to claim 3, wherein said metal is in the form of foil.

6. The conditioner according to claim 3, wherein said metal is aluminum in the form of foil.

7. The conditioner according to claim 1, wherein said shield means comprises at least two conductive layers including an outer conductive layer partially overlapping an inner conductive layer.

8. The conditioner according to claim 7, wherein said ground means is attached to said shield means by entrapment between any two of said at least two conductive layers.

* * * * *